US009341380B2

(12) United States Patent
Vaglica

(10) Patent No.: US 9,341,380 B2
(45) Date of Patent: May 17, 2016

(54) ATTACHMENT SYSTEM FOR AN IGNITER ELECTRODE FOR A GAS BURNER

(75) Inventor: Stefano Vaglica, Ispra (IT)

(73) Assignee: Whirlpool Corporation, Benton Harbor, MI (US)

( * ) Notice: Subject to any disclaimer, the term of this patent is extended or adjusted under 35 U.S.C. 154(b) by 1001 days.

(21) Appl. No.: 13/070,841

(22) Filed: Mar. 24, 2011

(65) Prior Publication Data

US 2011/0236840 A1 Sep. 29, 2011

(30) Foreign Application Priority Data

Mar. 25, 2010 (VA) ..... 2010U000010

(51) Int. Cl.

| | |
|---|---|
| ***F23D 11/42*** | (2006.01) |
| ***F23Q 3/00*** | (2006.01) |
| ***F24C 3/10*** | (2006.01) |
| *F24C 5/14* | (2006.01) |

(52) U.S. Cl.

CPC ..... *F24C 3/103* (2013.01); *F23Q 3/008* (2013.01); *F23D 2207/00* (2013.01); *F24C 5/14* (2013.01)

(58) Field of Classification Search

CPC ..... F24C 3/103; F24C 5/14; F23Q 3/002; F23Q 3/006; F23Q 3/008; F23C 2700/063; F23D 11/42; F23D 2207/00

USPC ..... 431/263, 264, 343; 126/39 E, 25 B; 248/687, 229.26, 74.2; 313/135

IPC ..... F23D 11/42; F23Q 3/00; F24C 3/10, F24C 5/14

See application file for complete search history.

(56) References Cited

U.S. PATENT DOCUMENTS

| | | | | | |
|---|---|---|---|---|---|
| 907,002 | A * | 12/1908 | Brownback | H01T 3/24 | 313/125 |
| 908,835 | A * | 1/1909 | Benford | H01T 3/34 | 174/152 S |
| 4,464,107 | A * | 8/1984 | Boe | F23Q 9/04 | 431/264 |
| 4,518,346 | A * | 5/1985 | Pistien | F23D 14/725 | 126/39 H |
| 4,854,857 | A * | 8/1989 | Houtman | 431/154 | |
| 5,405,263 | A * | 4/1995 | Gerdes et al. | 431/354 | |
| 5,553,818 | A * | 9/1996 | Wild | B60R 16/0222 | 248/56 |
| 5,839,403 | A * | 11/1998 | Grant | H01T 13/08 | 123/169 R |
| 6,012,443 | A * | 1/2000 | Peug | F24C 3/103 | 126/39 E |
| 6,027,335 | A * | 2/2000 | Griffioen | F23Q 9/04 | 431/266 |
| 6,173,708 | B1 * | 1/2001 | Arntz | F24C 3/085 | 126/39 H |

(Continued)

FOREIGN PATENT DOCUMENTS

| | | | | |
|---|---|---|---|---|
| AT | 400757 B | * | 3/1996 | F23Q 3/008 |
| DE | 10229852 C1 | * | 10/2003 | F02P 19/00 |

(Continued)

OTHER PUBLICATIONS

"DE_10229852_C1_M—Mach Trans.pdf", Machine Translation, http://epo.org, Sep. 27, 2014.*

(Continued)

*Primary Examiner* — Gregory Huson
*Assistant Examiner* — Daniel E Namay

(57) ABSTRACT

System for attaching the flame igniter electrode to a burner for gas hobs, boilers or the like. The system comprises a deformable seal of substantially annular shape mounted in a groove in the electrode which makes it possible to attach the electrode reversibly to a seat attached to the body of the burner. Attachment takes place through the application of an axial force inserting the electrode into the seat.

19 Claims, 4 Drawing Sheets

(56) References Cited

U.S. PATENT DOCUMENTS

| | | | | |
|---|---|---|---|---|
| 6,351,060 | B1 * | 2/2002 | Harneit | 313/326 |
| 6,607,378 | B2 * | 8/2003 | Harneit et al. | 431/354 |
| 6,621,197 | B1 * | 9/2003 | Francke | 313/118 |
| 6,780,009 | B2 * | 8/2004 | Harneit | 431/354 |
| 6,817,353 | B2 * | 11/2004 | Atkinson et al. | 126/39 E |
| 7,631,846 | B2 * | 12/2009 | Arnold et al. | 248/311.2 |
| 7,958,883 | B2 * | 6/2011 | Tecirlioglu | 126/52 |
| 8,511,294 | B2 * | 8/2013 | Paesani | 126/39 E |
| 2009/0036588 | A1 * | 2/2009 | Easter et al. | 524/444 |
| 2009/0297998 | A1 * | 12/2009 | Offredi | 431/258 |
| 2010/0003626 | A1 * | 1/2010 | Schlosser | F24C 3/103 431/264 |
| 2011/0129783 | A1 * | 6/2011 | Harneit | 431/144 |

FOREIGN PATENT DOCUMENTS

| | | | | | |
|---|---|---|---|---|---|
| EP | 0915298 | A2 | * | 5/1999 | |
| GB | 225633 | | | 12/1924 | |
| GB | 1344610 | | | 1/1974 | |
| GB | 1344610 | A | * | 1/1974 | |
| GB | 2083187 | A | * | 3/1982 | F23Q 3/006 |
| JP | 02157504 | A | * | 6/1990 | |
| JP | 03175203 | A | * | 7/1991 | |
| JP | 09329334 | A | * | 12/1997 | |
| JP | 2008008277 | A | * | 1/2008 | |
| WO | WO 2009098117 | A1 | * | 8/2009 | F23Q 3/008 |

OTHER PUBLICATIONS

European Search Report for Corresponding EP 11157615.3, Jun. 15, 2012.

* cited by examiner

ATTACHMENT SYSTEM FOR AN IGNITER ELECTRODE FOR A GAS BURNER

BACKGROUND OF THE INVENTION

1. Field of the Invention

This invention relates to a system for the attachment of an igniter electrode to a gas burner, and an electrode and burner body shaped for such attachment.

In greater detail the subject matter of this invention relates to an attachment system for a flame ignition electrode which is easy to assemble on a support on the body of a burner during the process of manufacture, in particular during the process of manufacturing a hob, a gas cooker or a boiler, and which can easily be removed in the event of repair.

2. Description of the Related Art

Gas burners in which the flame igniter electrode is attached to a support extending from the body of the gas burner by means of a metal clip are known in the art. As illustrated in FIGS. 1 and 2, this attachment takes place through an annular groove in the body of the electrode located in the part of the electrode projecting beneath the support into which an attachment clip is inserted.

In addition to requiring an operation of assembling the gas hob after the electrode has been assembled with the burner body, this known method of attachment also requires there to be a certain amount of lateral space for insertion of the clip by the operator, which typically requires two separate manual movements—namely inserting the igniter and holding the igniter in position while attaching the clip. Finally, because of its dimensions, the clip restricts possible configurations for mounting burners fitted with an igniter electrode, especially where the profile of the electrode together with that of the burner body has to be particularly compact in order not to project greatly from the surface of the hob. These configurations are normally referred to as flat burners.

A gas burner which has an annular base provided with a housing and an external support of ceramic shaped in such a way as to engage the housing, and which provides a support for the burner igniter electrode, is known from document GB-A-225633. This solution requires an additional annular base which extends around the body of the burner, but which is not of one piece with the burner body itself, because this base has to be fitted above the working surface, on the side opposite the burner body. With regard to the previously-described solution the position of the electrode on the annular support makes electrical connection of the electrode to the high voltage current generating unit which produces the discharge more complex. In fact in the solutions previously described the electrode already connected to the cable can be pre-assembled to the burner body and can be immediately connected to the unit through a single connection. In this complex configuration two electrical cable connections are however necessary: the first to the unit and the second to the electrode. In addition to this the connection to the electrode can be made, with difficulty, only when the working surface is enclosed, because the annular base and the electrode are of one piece with it. Incorporation of the annular base into the burner body is not therefore possible.

SUMMARY OF THE INVENTION

Finally, a solution which provides for mere bonding or irreversible attachment of the electrode to the burner body is not a solution which can be applied to hobs and boilers because if the electrode has to be repaired it would be necessary to replace the entire block, rather than replace the individual component.

The limitations deriving from known solutions have been overcome in the present invention thanks to the features according to the appended claims.

BRIEF DESCRIPTION OF THE DRAWINGS

Further advantages and features of this invention will be apparent from the following detailed description provided by way of example with reference to the appended drawings in which.

DETAILED DESCRIPTION OF THE PREFERRED EMBODIMENTS

With reference to the figures mentioned, the body of an atmospheric burner CB is attached, preferably in a removable manner, to the frame CH of a built-in hob PG. This body is normally a die-cast part of metal material, preferably of aluminium or aluminium alloy, which is preferably of circular shape. A pipe TG for feeding gas and a gas delivery nozzle in fluid connection with the feed pipe, calibrated according to the type and according to the flow of gas which has to be delivered, are attached to said burner body CB.

A flame spreader SA and the overlying cap (not shown) are subsequently connected to the said burner body.

A support SR for additional components extends laterally from the said burner body in a radial direction. The said support SR, which is preferably of one piece with burner body CB, has a seat SL for housing a flame igniter electrode ET, and may have a seat SD for housing a heat-sensitive element for detecting flame ignition, typically a thermocouple TC with an outer coating of metal material.

The seat of the electrode ET normally comprises a hole of circular cross-section passing through the support from the top of the support LSU to the bottom thereof LIN.

The seat preferably has a longitudinal notch INT which places the interior of the hole in communication with the outer part of the support. The said notch INT is provided to assist fitting of electrode ET which has previously been fitted with the corresponding electrical connection cables CE. The said seat may possibly have a circular groove (shown in FIG. 7) within the seat to help hold the electrode constructed according to the invention.

Similarly, seat SD for heat-sensitive element TC comprises a second through hole, preferably parallel to that of the seat for the electrode and a second notch. The longitudinal section of the through hole may have a tapering profile so that the parts mate together through insertion under pressure applied by the operator during the manufacturing process of assembling the hob.

According to the invention, electrode ET has a cylindrical profile along the longitudinal axis of which is provided a conductor COND for delivering the ignition sparks, around which there is concentrically provided a ceramic coating RIV. The ceramic coating is necessary to insulate the conductor from the metal body of the burner. An insulated electrical cable CE for connecting the conductor to a unit generating electrical discharges is connected to the lower extremity of electrode ET.

Figure 1:
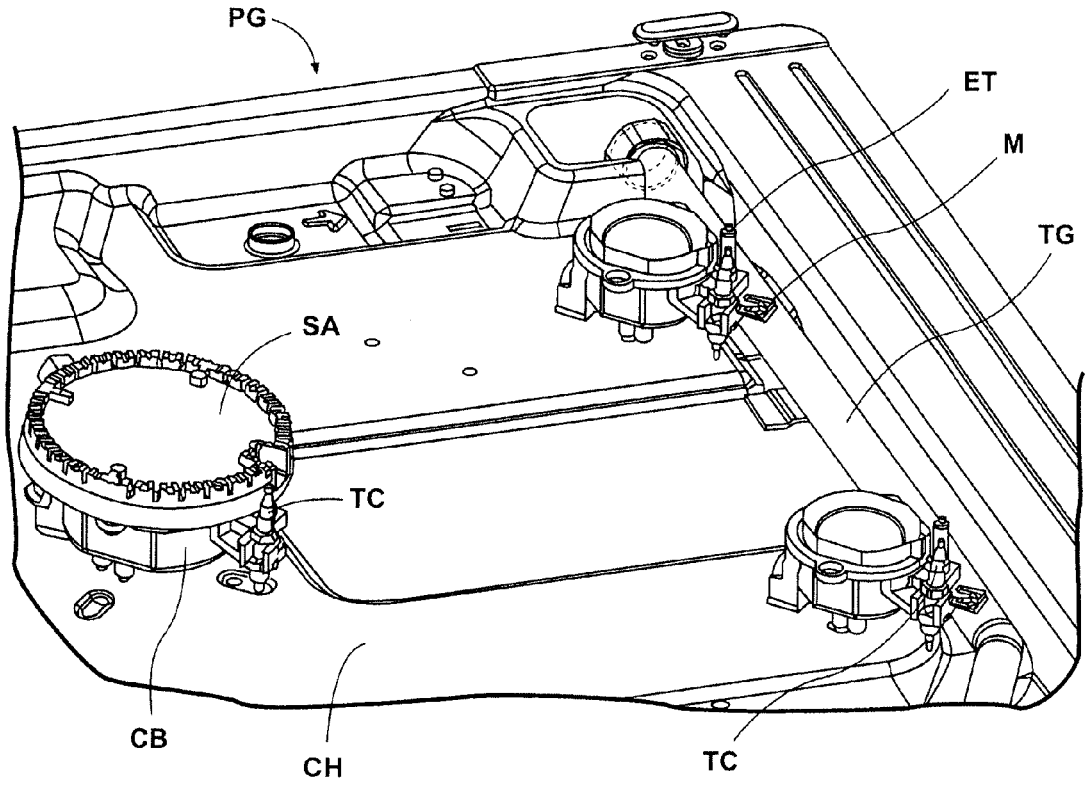
Fig. 1 Prior Art
FIG. 1 shows an attachment solution which is known in the art.
Figure 2:
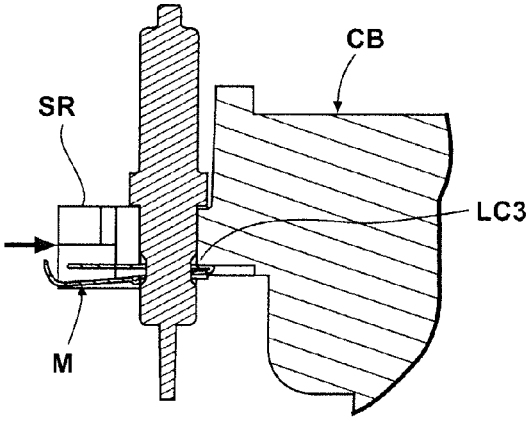
Fig. 2 Prior Art
FIG. 2 shows the electrode attachment described in FIG. 1 in section.
Figure 3:
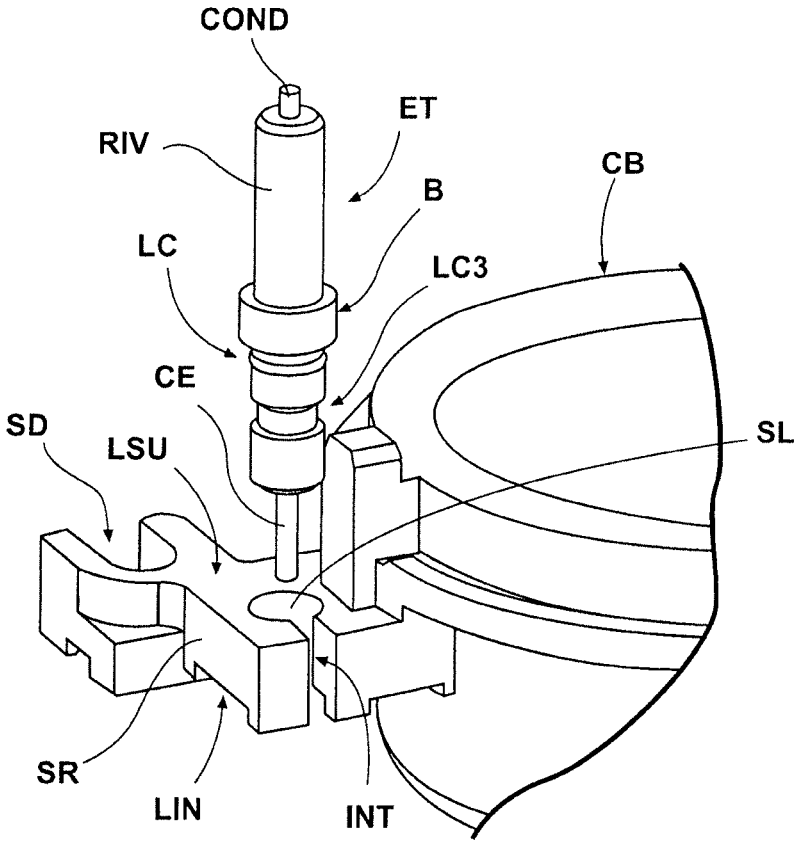
FIG. 3 shows an exploded view of the attachment system according to the invention.
Figure 4:
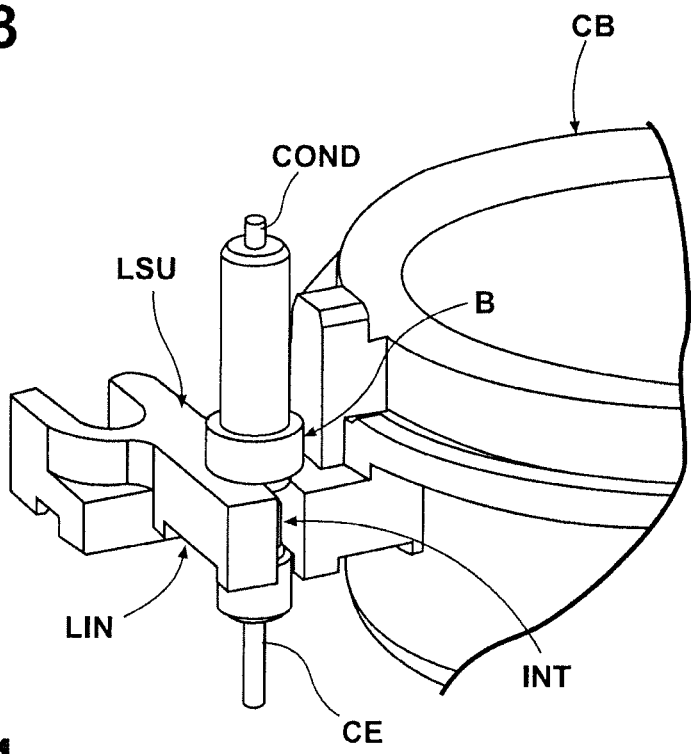
FIG. 4 shows the assembled system in FIG. 3.
Figure 5:
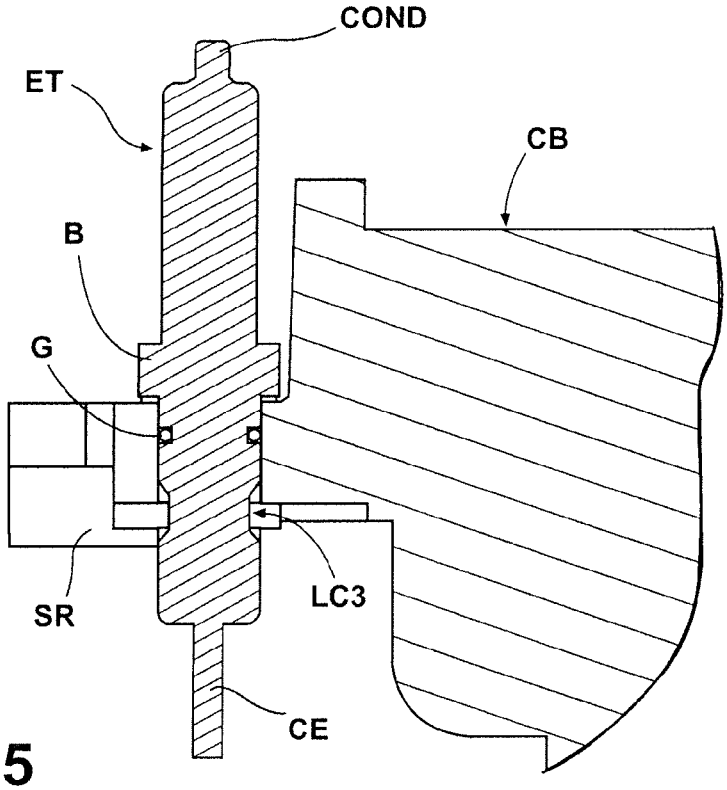
FIG. 5 shows a section through the assembled system according to the invention.
Figure 6:
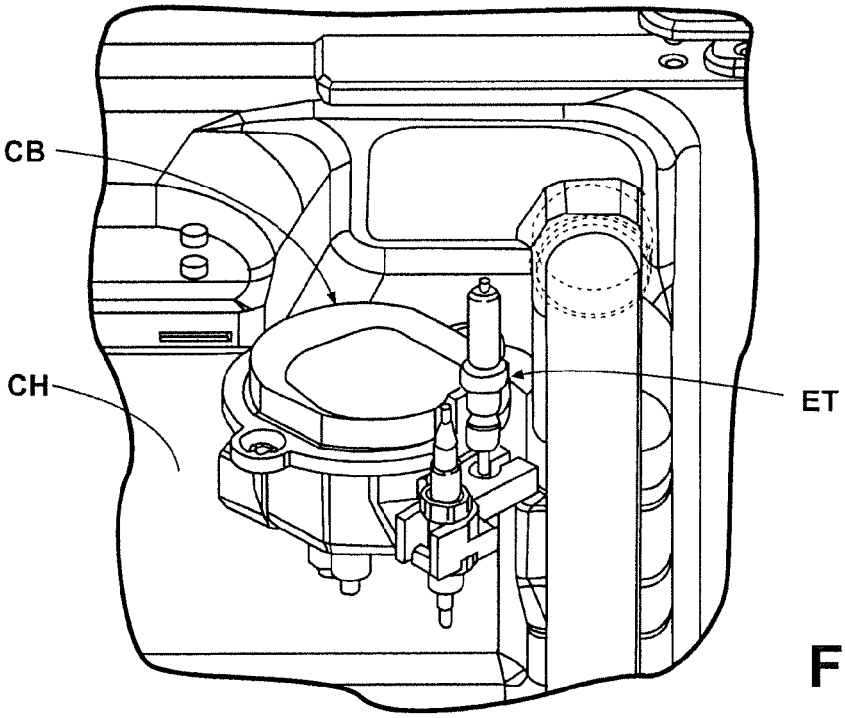
FIG. 6 provides a general perspective view of the system in FIG. 3.

The longitudinal section of the electrode in FIG. 5 shows the presence of an annular edge B in the ceramic coating abutting the top LSU of support SR when the electrode is positioned in its seat SL. This edge preferably has circular symmetry.

Figure 7:
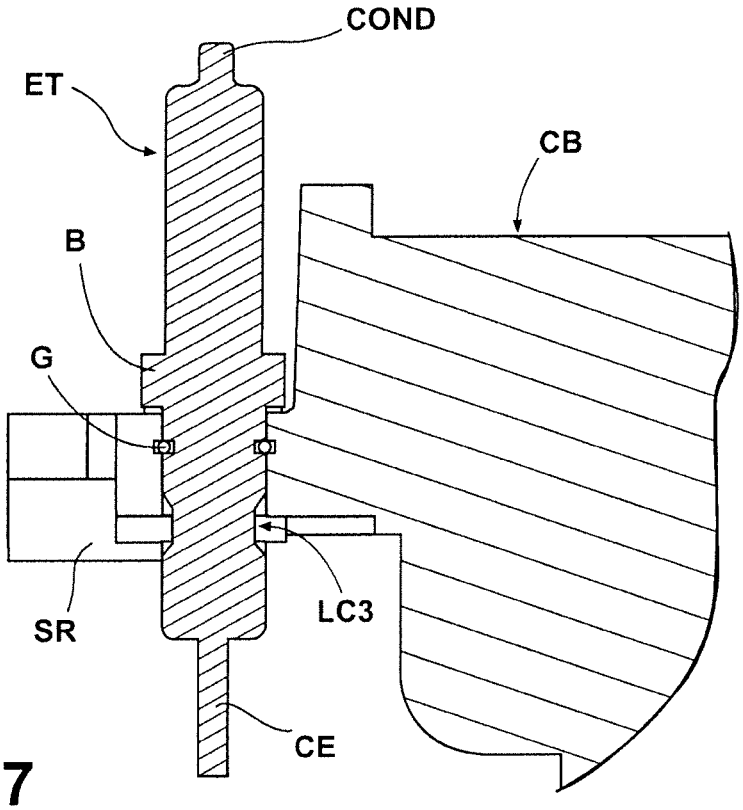
FIG. 7 shows a section through the assembly system according to another embodiment of the invention.

According to the invention the ceramic lining has a groove LC which preferably extends along its entire perimeter. When the electrode is inserted in seat SL said groove LC remains within the seat and is preferably opposite the groove, when present (as shown in FIG. 7). Groove LC and the groove form a holding position within which seal G is held.

The groove comprises a seat housing a seal G of elastomer material which is resistant to high temperatures, for example silicone resistant to a working temperature within the range 150 and 200° C., preferably 170° C.

The seal G preferably has a circular section to assist fitting in groove LC. Seal G is for example a ring of the O-ring type of silicone rubber.

In the process of assembling a hob or gas cooker seal G is fitted onto electrode ET and positioned in groove LC before being assembled onto the body of gas burner CB.

During the operation of assembling the hob, electrode ET fitted with its seal G is slid into its seat and secured by deformation of the seal against the body of the burner by the operator exerting a pressure on the component in the axial direction of insertion. The elasticity of seal G ensures that electrode ET is stably positioned in seat SL.

Although a resilient seal of elastomer material has been described so far, for the purposes of the invention it is also possible to use a resilient seal of metal material whose shape may also be of the semicircular type.

The system according to the invention permits simpler and quick insertion of the electrode, eliminating use of fixing clip M.

In addition to this, because less space is required for attaching the electrode it is also possible to use electrodes of this type in hob configurations in which such spaces are not available, in particular in the flat hobs also known as "flat burners".

In order to render the electrode interchangeable with the electrodes already present on the market the latter may also have a further groove LC3 of a known type, in addition to groove LC, for attaching the electrode through the previously known method using clip M.

I claim:

1. In a gas hob or boiler, a system for attachment of an electrode for igniting a flame comprising:

a burner body from which there laterally extends a support connected to the burner body, the support being provided with a seat for housing an electrode, the seat being provided with a first groove, the electrode being provided with a second groove opposite the first groove for housing an element for attachment of the electrode; and a deformable attachment element for the electrode of substantially annular shape, the deformable attachment element being housed in the second groove in the electrode without requiring compression of the deformable attachment element such that, when the electrode fitted with the deformable attachment element is inserted into the seat following the application of an axial insertion force, the deformable attachment element deforms within the seat reversibly attaching the electrode in an operating position within the seat of the support of the burner body, wherein the first groove and the second groove are configured to hold the deformable attachment element in a sealing position.

2. The system according to claim 1, in which the deformable attachment element is a material capable of supporting a working temperature within the range from 150° C. to 200° C.

3. The system according to claim 2, in which the deformable attachment element is a silicone material.

4. The system according to claim 1, in which the support is one piece with the burner body.

5. The system according to claim 1, wherein the electrode has an abutting edge with a lower face, the lower face engaging a top surface of the support.

6. The system according to claim 1, in which the electrode has a further seat for resilient attachment of the electrode to an underside of the support by a resilient clip.

7. The system according to claim 1, wherein the first groove is defined by a portion of an inner perimeter of the seat that has a larger diameter than either of two adjacent portions of the inner perimeter of the seat.

8. In a gas hob or boiler, an electrode for igniting a flame of a burner comprising:

an insulating body;

a conductor enclosed in the insulating body;

a groove to receive an electrode fixing element; and an abutting edge with a lower face;

wherein the electrode fixing element comprises a resilient attachment element in the groove, the resilient attachment element of substantially annular shape and configured to permit reversible attachment of the electrode to a burner body when in use following application of an axial insertion force, wherein the resilient attachment element is located in the groove after attachment of the electrode to the burner body; and wherein the lower face of the abutting edge engages a top surface of a support of the burner body when the electrode is attached to the burner body;

whereby no resilient clip is necessary for attachment of the electrode to the burner body.

9. The electrode according to claim 8, in which the resilient attachment element is a seal of resilient material of circular section.

10. The electrode according to claim 8, in which the groove is provided in the insulating body.

11. The electrode according to claim 8, further comprising a seat for attachment of the electrode to a support through a resilient clip.

12. The electrode according to claim 8, wherein the groove is defined by a portion of an outer perimeter of the electrode that has a smaller diameter than either of two adjacent portions of the outer perimeter of the electrode.

13. In a gas hob or boiler, a system for attachment of an electrode for igniting a flame comprising:

a burner body from which there laterally extends a support connected to the burner body, the support being provided with a seat for housing an electrode, the electrode being provided with a groove for housing an element for attachment of the electrode, wherein the electrode has an abutting edge with a lower face, the lower face engaging a top surface of the support; and a deformable attachment element for the electrode of substantially annular shape, the deformable attachment element being housed in the groove of the electrode and located entirely between a first end of the electrode and a second, opposite end of the electrode such that, when the electrode fitted with the deformable attachment element is inserted into the seat and following the application of an axial insertion force, the deformable attachment element deforms within the seat reversibly attaching the electrode in an operating position within the seat of the support of the burner body.

14. The system according to claim 13, wherein the deformable attachment element is a material supporting a working temperature within the range from 150° C. to 200° C.

15. The system according to claim 14, wherein the deformable attachment element is a silicone material.

16. The system according to claim 13, wherein the support is one piece with the burner body.

17. The system according to claim 13, wherein the groove constitutes a first groove and the seat for attachment of the electrode also comprises a second groove opposite the first groove, the first groove and the second groove being configured to hold the deformable attachment element in a sealing position.

18. The system according to claim 13, wherein the electrode has a further seat for resilient attachment of the electrode to an underside of the support by a resilient clip.

19. The system according to claim 13, wherein the groove is defined by a portion of an inner perimeter of the seat that has a larger diameter than either of two adjacent portions of the inner perimeter of the seat.

* * * * *